US011165169B2

(12) United States Patent
Kim et al.

(10) Patent No.: US 11,165,169 B2
(45) Date of Patent: Nov. 2, 2021

(54) ANTENNA STRUCTURE AND DISPLAY DEVICE INCLUDING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Jong Min Kim, Gyeonggi-do (KR); Dong Pil Park, Incheon (KR); Yun Seok Oh, Gyeonggi-do (KR); Won Bin Hong, Seoul (KR)

(73) Assignees: DONGWOO FINE-CHEM CO., LTD., Jeollabuk-Do (KR); POSTECH RESEARCH AND BUSINESS DEVELOPMENT FOUNDATION, Gyeongsangbuk-Do (KR)

( * ) Notice: Subject to any disclaimer, the term of this patent is extended or adjusted under 35 U.S.C. 154(b) by 0 days.

(21) Appl. No.: 16/827,967

(22) Filed: Mar. 24, 2020

(65) Prior Publication Data

US 2020/0227835 A1 Jul. 16, 2020

Related U.S. Application Data

(63) Continuation of application No. PCT/KR2019/012456, filed on Sep. 25, 2019.

(30) Foreign Application Priority Data

Oct. 5, 2018 (KR) ..... 10-2018-0119072

(51) Int. Cl.
*H01Q 21/06* (2006.01)
*H01Q 9/04* (2006.01)
(Continued)

(52) U.S. Cl.
CPC ..... *H01Q 21/065* (2013.01); *H01Q 1/22* (2013.01); *H01Q 9/0407* (2013.01); *H01Q 21/0075* (2013.01)

(58) Field of Classification Search
CPC ..... H01Q 21/0006; H01Q 21/0075; H01Q 21/06; H01Q 21/061; H01Q 21/065;
(Continued)

(56) References Cited

U.S. PATENT DOCUMENTS 9,391,375 B1 * 7/2016 Bales ..... H01Q 21/24
10,062,972 B1 * 8/2018 Strassner, II ..... H01Q 3/28
(Continued)

FOREIGN PATENT DOCUMENTS

CN 103872459 A 6/2014
CN 106104915 A 11/2016
(Continued)

OTHER PUBLICATIONS

Office action dated Jul. 5, 2021 from China Patent Office in a counterpart China Patent Application No. 201910923759.X (all the cited references are listed in this IDS.) (English translation is also submitted herewith.).

*Primary Examiner* — Jason Crawford
(74) *Attorney, Agent, or Firm* — The PL Law Group, PLLC

(57) ABSTRACT

An antenna structure includes an antenna device including a dielectric layer and a plurality of radiation patterns on an upper surface of the dielectric layer, and a flexible circuit board including a feeding wiring electrically connected to the radiation patterns. The feeding wiring includes a plurality of individual wirings, each of which electrically connected to each of the radiation patterns, and lengths of
(Continued)

neighboring individual wirings included in at least one pair from the plurality of individual wirings are different from each other.

18 Claims, 5 Drawing Sheets

(51) Int. Cl.
*H01Q 1/22* (2006.01)
*H01Q 21/00* (2006.01)

(58) Field of Classification Search
CPC ..... H01Q 9/04; H01Q 9/0407; H01Q 1/36; H01Q 1/38
See application file for complete search history.

(56) References Cited

U.S. PATENT DOCUMENTS

2006/0170597 A1* 8/2006 Kurashima ..... H01Q 1/242 343/700 MS
2011/0050534 A1* 3/2011 Shimayama ..... H01Q 1/3233 343/850
2011/0090129 A1* 4/2011 Weily ..... H01Q 21/24 343/770
2011/0134008 A1* 6/2011 Schadler ..... H01Q 21/065 343/833
2011/0304515 A1* 12/2011 Wellman ..... H01Q 15/08 343/720
2015/0303585 A1* 10/2015 Chistyakov ..... H01Q 21/0006 343/853
2016/0079666 A1* 3/2016 Camilleri ..... H01Q 3/24 342/368
2018/0123222 A1* 5/2018 Jang ..... H01Q 21/065
2019/0058264 A1* 2/2019 Jung ..... H01Q 1/243
2020/0194896 A1* 6/2020 Huh ..... H01Q 1/2291

FOREIGN PATENT DOCUMENTS

JP 60-94510 A 5/1985
JP 2004-112397 A 4/2004
JP 2010-118982 A 5/2010
JP 2011-120240 A 6/2011
KR 10-2013-0095451 A 8/2013
KR 10-2015-0104509 A 9/2015

* cited by examiner

ANTENNA STRUCTURE AND DISPLAY DEVICE INCLUDING THE SAME

CROSS-REFERENCE TO RELATED APPLICATION AND CLAIM OF PRIORITY

The present application is a continuation application to International Application No. PCT/KR2019/012456 with an International Filing Date of Sep. 25, 2019, which claims the benefit of Korean Patent Application No. 10-2018-0119072 filed on Oct. 5, 2018 at the Korean Intellectual Property Office (KIPO), the entire disclosures of which are incorporated by reference herein in their entirety.

BACKGROUND

1. Field

The present invention relates to an antenna structure and a display device including the same. More particularly, the present invention related to an antenna structure including an electrode and a dielectric layer, and a display device including the same.

2. Description of the Related Art

As information technologies have been developed, a wireless communication technology such as Wi-Fi, Bluetooth, etc., is combined with a display device in, e.g., a smartphone. In this case, an antenna may be combined with the display device to provide a communication function.

Mobile communication technologies have been rapidly developed, an antenna capable of operating an ultra-high frequency communication is needed in the display device.

For example, in a recent 5G high frequency range communication, as a wavelength becomes shorter, a signal transfer/reception may be blocked and an operable frequency band for the signal transfer/reception may become narrower to cause a signal loss. Thus, demands for a high frequency antenna having desired directivity, gain and signaling efficiency are increasing.

Further, as a display device to which the antenna is applied becomes thinner and light-weighted, a space for accommodating the antenna may be also decreased. Thus, a high-frequency and broadband signaling may not be easily implemented in a limited space.

For example, Korean Published Patent Application No. 2013-0095451 discloses an antenna integrated into a display panel, however, fails to provide solutions to the above issues.

SUMMARY

According to an aspect of the present invention, there is provided an antenna structure having improved signaling efficiency and reliability.

According to an aspect of the present invention, there is provided a display device including an antenna structure with improved signaling efficiency and reliability.

The above aspects of the present invention will be achieved by the following features or constructions:

(1) An antenna structure, including: an antenna device including a dielectric layer and a plurality of radiation patterns on an upper surface of the dielectric layer; and a flexible circuit board including a feeding wiring electrically connected to the radiation patterns, wherein the feeding wiring includes a plurality of individual wirings, each of which electrically connected to each of the radiation patterns, and lengths of neighboring individual wirings included in at least one pair from the plurality of individual wirings are different from each other.

(2) The antenna structure according to the above (1), wherein the feeding wiring further includes a connecting wiring that couples the neighboring individual wirings in a predetermined unit.

(3) The antenna structure according to the above (2), wherein the neighboring individual wirings are connected to each other by the connecting wiring to define a plurality of feeding units, and lengths of the individual wirings included in each of the feeding units are different from each other.

(4) The antenna structure according to the above (3), wherein lengths of individual wirings neighboring each other which are included in different feeding units of the plurality of the feeding units are different from each other.

(5) The antenna structure according to the above (3), wherein a phase difference is generated between the radiation patterns connected to each of the feeding units, and the phase difference from each of the feeding units is constant.

(6) The antenna structure according to the above (5), wherein a phase difference is generated by neighboring individual wirings included in different feeding units of the plurality of feeding units, and the phase difference by the neighboring individual wirings included in the different feeding units is equal to the phase difference from each of the feeding units, wherein phases of the plurality of the radiation patterns constantly increase or decrease in an arrangement direction thereof.

(7) The antenna structure according to the above (3), wherein at least one of the individual wirings included in each of the feeding units has a bent portion protruding in an arrangement direction of the feeding units.

(8) The antenna structure according to the above (1), wherein the antenna electrode layer further includes a signal pad electrically connected to each of the radiation patterns, and the feeding wiring is electrically connected to the signal pad.

(9) The antenna structure according to the above (8), wherein the flexible circuit board includes a core layer and a feeding ground layer formed on an upper surface of the core layer, wherein the feeding wiring is disposed on a lower surface of the core layer.

(10) The antenna structure according to the above (9), wherein the antenna electrode layer further includes a ground pad around the signal pad, and the feeding ground layer of the flexible circuit board is electrically connected to the ground pad.

(11) The antenna structure according to the above (10), further including a ground contact electrically connecting the feeding ground layer and the ground pad to each other.

(12) The antenna structure according to the above (1), wherein the flexible circuit board is disposed on the antenna electrode layer of the antenna device.

(13) The antenna structure according to the above (1), wherein the flexible circuit board is disposed under a lower surface of the dielectric layer of the antenna device.

(14) The antenna structure according to the above (13), wherein the antenna electrode layer is bent along a sidewall of the dielectric layer and extends on the lower surface of the dielectric layer.

(15) The antenna structure according to the above (14), wherein the flexible circuit board further includes a feeding contact electrically connecting the antenna electrode layer and the feeding wiring to each other.

(16) The antenna structure according to the above (1), wherein the antenna device further includes an antenna ground layer disposed on the lower surface of the dielectric layer.

(17) The antenna structure according to the above (1), further including a driving integrated circuit chip being disposed on the flexible circuit board and supplying a power with the antenna electrode layer via the feeding wiring.

(18) The antenna structure according to the above (1), wherein the antenna electrode layer includes a mesh structure.

(19) The antenna structure according to the above (18), wherein the antenna device further includes a dummy mesh layer around the antenna electrode layer.

(20) A display device including the antenna structure according to any one of the above (1) to (19).

In an antenna structure according to exemplary embodiments, individual wirings neighboring each other and being electrically connected to different radiation patterns may have different lengths. Accordingly, a phase difference may be generated between the neighboring radiation patterns to implement a beam tilting. Thus, a beam coverage of the antenna may be enlarged.

In some embodiments, a flexible circuit board may further include a feeding ground disposed at an upper level of a feeding wiring. Accordingly, a self-radiation from the feeding wiring may be shielded or reduced.

In some embodiments, at least a portion of an antenna electrode layer may be formed as a mesh structure so that transmittance of the antenna structure may be improved. For example, the antenna structure may be employed in a display device including a mobile communication device for implementing 3G to 5G high frequency communications to also improve radiation property and optical property such as transmittance.

DETAILED DESCRIPTION OF THE EMBODIMENTS

According to exemplary embodiments of the present invention, an antenna structure is provided. The antenna structure may include an antenna device including a plurality of radiation patterns and a flexible circuit board including a feeding wiring electrically connected to the radiation patterns. The feeding wiring may include individual wirings each of which is connected to each radiation pattern, and neighboring individual wirings included in at least one pair from the individual wirings may have different lengths so that signaling efficiency and beam coverage of the antenna structure may be improved.

The antenna structure or the antenna device may be a micro-strip patch antenna fabricated as a transparent film. The antenna structure may be applied to high frequency or ultra-high frequency (for example, 3G, 4G, 5G or more) mobile communication devices.

According to exemplary embodiments of the present invention, a display device including the antenna structure is also provided.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

In the accompanying drawings, two directions being parallel to an upper surface of a dielectric layer 110 and crossing each other are defined as a first direction and a second direction. For example, the first direction and the second direction may be perpendicular to each other. A vertical direction with respect to the upper surface of the dielectric layer 110 is defined as a third direction. For example, the first direction may be a length direction (an extending direction of a transmission line) of the antenna structure, the second direction may be a width direction of the antenna structure, and the third direction may be a thickness direction of the antenna structure.

Figure 1:
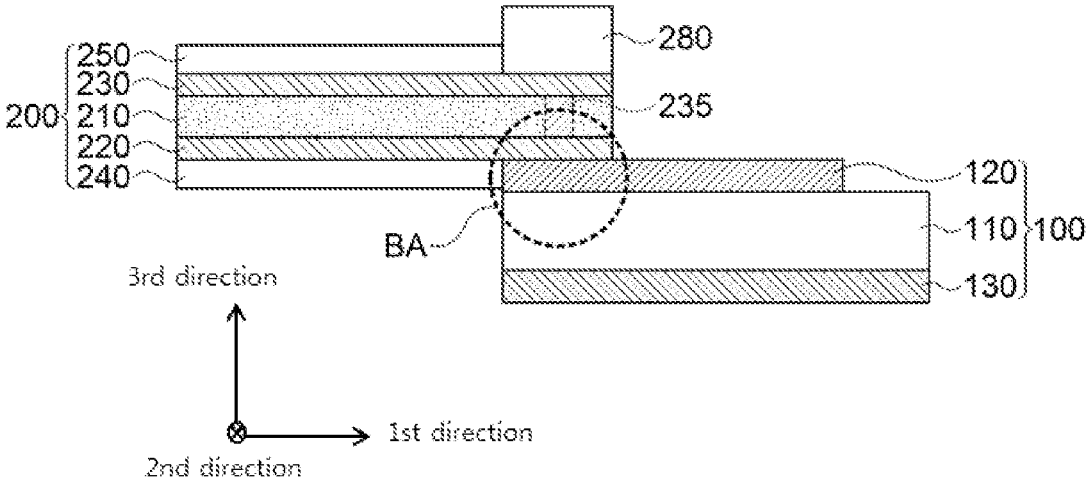
FIG. 1 is a schematic cross-sectional view illustrating an antenna structure in accordance with exemplary embodiments.

FIG. 1 is a schematic cross-sectional view illustrating an antenna structure in accordance with exemplary embodiments.

Referring to FIG. 1, the antenna structure may include an antenna device (e.g., a film antenna) 100 and a flexible circuit board (e.g., FPCB) 200. The antenna structure may further include a driving integrated circuit (IC) chip 280 electrically connected to the antenna device 100 via the flexible circuit board 200.

The antenna device 100 may include a dielectric layer 110 and an antenna electrode layer 120 disposed on an upper surface of the dielectric layer 110. In some embodiments, an antenna ground layer 130 may be formed on a lower surface of the dielectric layer 110.

The dielectric layer 110 may include, e.g., a transparent resin material. For example, the dielectric layer 110 may include a thermoplastic resin, e.g., a polyester-based resin such as polyethylene terephthalate, polyethylene isophthalate, polyethylene naphthalate, polybutylene terephthalate, etc.; a cellulose-based resin such as diacetyl cellulose, triacetyl cellulose, etc.; a polycarbonate-based resin; an acryl-based resin such as polymethyl (meth)acrylate, polyethyl (meth)acrylate, etc.; a styrene-based resin such as polystyrene, an acrylonitrile-styrene copolymer; a polyolefin-based resin such as polyethylene, polypropylene, a polyolefin having a cyclo or norbornene structure, etc.; a vinyl chloride-based resin; an amide-based resin such as nylon, an aromatic polyamide, etc.; an imide-based resin; a polyether sulfone-based resin; a sulfone-based resins; a polyether ether ketone-based resin; a polyphenylene sulfidebased resin; a vinyl alcohol-based resin; a vinylidene chloride-based resin; a vinyl butyral-based resin; an allylate-based resin; a polyoxymethylene-based resin; an epoxy-based resin, or the like. These may be used alone or in a combination thereof.

A transparent film formed of a thermosetting resin or an ultraviolet curable resin such as a (meth)acryl-based resin, an urethane-based resin, an acryl urethane-based resin, an epoxy-based resin, a silicone-based resin, etc., may be also used as the dielectric layer 110. In some embodiments, an adhesive film including, e.g., an optically clear adhesive (OCA) or an optically clear resin (OCR) may be included in the dielectric layer 110.

In some embodiments, the dielectric layer 110 may include an inorganic material such as silicon oxide, silicon nitride, silicon oxynitride, glass, etc.

The dielectric layer 110 may be a substantially single layer or may have a multi-layered structure including at least two layers.

A capacitance or an inductance may be created between the antenna electrode layer 120 and the antenna ground layer 130 by the dielectric layer 110 so that a frequency range in which the antenna device 100 may be operated may be controlled. In some embodiments, a dielectric constant of the dielectric layer 110 may be in a range from about 1.5 to about 12. If the dielectric constant exceeds about 12, a driving frequency may be excessively decreased and a desired high-frequency radiation may not be implemented.

The antenna electrode layer 120 may include a radiation pattern. In exemplary embodiments, the antenna electrode layer 120 may further include a transmission line and a pad electrode, and the pad electrode and the radiation pattern may be electrically connected to each other via the transmission line. The pad electrode may include a signal pad and a ground pad. Elements and structures of the antenna electrode layer 120 may be described in more detail with reference to FIG. 2.

The antenna ground layer 130 may be disposed on the lower surface of the dielectric layer 110. In some embodiments, the antenna ground layer 130 may entirely cover or entirely overlap the antennal electrode layer 120 in a planar view.

The antenna electrode layer 120 and the antenna ground layer 130 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), tin (Sn), zinc (Zn), molybdenum (Mo), calcium (Ca) or an alloy thereof. These may be used alone or in a combination thereof.

In an embodiment, the antenna electrode layer 120 may include silver (Ag) or a silver alloy such as a silver-palladium-copper (APC) alloy may be used to enhance a low resistance property. In an embodiment, the antenna electrode layer 120 may include copper (Cu) or a copper alloy in consideration of low resistance and pattern formation with a fine line width. For example, the antenna electrode layer 120 may include a copper-calcium (Cu—Ca) alloy.

In some embodiments, the antenna electrode layer 120 and the antenna ground layer 130 may include a transparent metal oxide such as indium tin oxide (ITO), indium zinc oxide (IZO), indium zinc tin oxide (IZTO), zinc oxide ($ZnO_x$), etc.

In some embodiments, the antenna electrode layer 120 may include a multi-layered structure including the transparent conductive oxide and the metal. For example, the antenna electrode layer 120 may have a triple-layered structure of a transparent conductive oxide layer-a metal layer-a transparent conductive oxide layer. In this case, a flexible property may be enhanced by the metal layer so that a resistance may be reduced and a signal transfer speed may be improved. Further, a resistance to corrosion and a transparency may be enhanced by the transparent conductive oxide layer.

The flexible circuit board 200 may be disposed on the antenna electrode layer 120 to be electrically connected to the antenna device 100. The flexible circuit board 200 may include a core layer 210, a feeding wiring 220 and a feeding ground layer 230. An upper coverlay film 250 and a lower coverlay film 240 may be formed on an upper surface and a lower surface of the core layer 210, respectively, to protect wirings.

The core layer 210 may include a flexible resin material such as polyimide, an epoxy resin, polyester, a cyclo olefin polymer (COP), a liquid crystal polymer (LCP), etc.

The feeding wiring 220 may be disposed on, e.g., the lower surface of the core layer 210. The feeding wiring 220 may serve as a power dividing wiring from the driving IC chip 280 to the antenna electrode layer 120.

In exemplary embodiments, the feeding wiring 220 may be electrically connected to the antenna electrode layer 120 (e.g., a signal pad 126 of FIG. 2) via a conductive intermediate structure.

The conductive intermediate structure may be prepared from, e.g., an anisotropic conductive film (ACF). In this case, the conductive intermediate structure may include conductive particles (e.g., silver particles, copper particles, carbon particles, etc.) dispersed in a resin layer.

As illustrated in FIG. 1, a bonding area BA may be defined by a region at which the antenna electrode layer 120 and the feeding wiring 220 are combined with each other.

For example, the lower coverlay film 240 may be partially cut or removed to expose a portion of the feeding wiring 220 having a size corresponding to the bonding area BA. The exposed portion of the feeding wiring 220 and the antenna electrode layer 120 may be bonded by applying a pressure so that a bonding structure may be obtained at the bonding area BA. In some embodiments, the conductive intermediate structure may be interposed between the feeding wiring 220 and the antenna electrode layer 120.

The feeding ground layer 230 may be disposed on the upper surface of the core layer 210. The feeding ground layer 230 may have a line shape or a plate shape. The feeding ground layer 230 may serve as a barrier shielding or suppressing a noise or a self-radiation from the feeding wiring 220.

The feeding wiring 220 and the feeding ground layer 230 may include the above-mentioned metal and/or alloy.

In some embodiments, the feeding ground layer 230 may be electrically connected to a ground pad 123 and 125 (see FIG. 2) of the antenna electrode layer 120 via a ground contact 235 formed through the core layer 210.

In some embodiments, the feeding ground layer 230 and the ground pad 123 and 125 may be electrically connected via a plurality of the ground contacts 235. A diameter of the ground contact 235 may be 30 μm or more, and a distance between neighboring ground contacts 235 may be 2 times the diameter or more. A current flow between the feeding ground layer 230 and the ground pad 123 and 125 may be enhanced by the plurality of the ground contacts 235 having the above-mentioned construction so that the noise from the radiation pattern 122 or the feeding wiring 220 may be efficiently removed. The diameter of the ground contact 235 may be 200 μm or less, and the distance between neighboring ground contacts 235 may be 4 times the diameter or more. More preferably, the diameter of the ground contact 235 may be 50 μm to 100 μm, and the distance between neighboring ground contacts 235 may be 2 to 3 times the diameter.

The driving IC chip 280 may be disposed on the flexible circuit board 200. In some embodiments, the driving IC chip 280 may be mounted directly on the flexible circuit board 200. A power may be supplied from the driving IC chip 280 to the antenna electrode layer 120 through the feeding wiring 220. For example, the driving IC chip 280 may further include a circuit or a contact configured to electrically connect the driving IC chip 280 and the feeding wiring 220.

Figure 2:
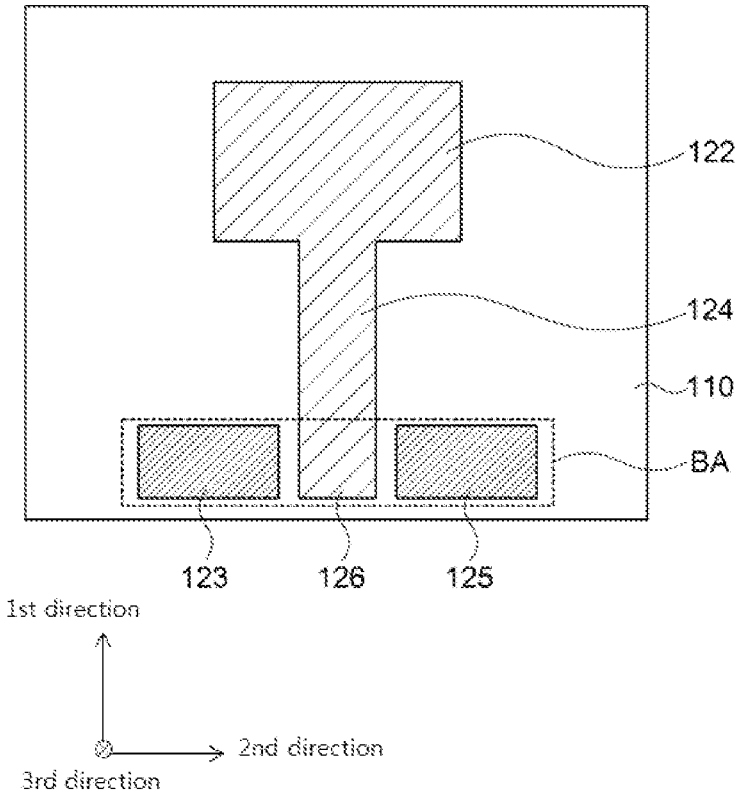
FIG. 2 is a schematic top planar view illustrating a construction of an antenna electrode layer included in an antenna structure in accordance with exemplary embodiments.

FIG. 2 is a schematic top planar view illustrating a construction of an antenna electrode layer included in an antenna structure in accordance with exemplary embodiments.

Referring to FIG. 2, as described above, the antenna electrode layer 120 may include the radiation pattern 122, the transmission line 124 and the pad electrodes. The pad electrodes may include a signal pad 126 and the ground pads 123 and 125.

The transmission line 124 may be diverged from the radiation pattern 122 to extend in the first direction. In an embodiment, the transmission line 124 may be substantially integral with the radiation pattern 122 as a unitary member.

In some embodiments, a terminal portion of the transmission line 124 may serve as the signal pad 126. The ground pad may include a first ground pad 123 and a second ground pad 125. The first ground pad 123 and the second ground pad 125 may face each other in the second direction with respect to the signal pad 126.

An area covering the signal pad 126 and the ground pads 123 and 125 in a planar view may correspond to the bonding area BA for being connected to the flexible circuit board 200 as illustrated in FIG. 1.

In some embodiments, the feeding wiring 220 of the flexible circuit board 200 may be selectively connected to the signal pad 126. In this case, an area covering the signal pad 126 in FIG. 2 may be defined as the bonding area BA.

Figure 3:
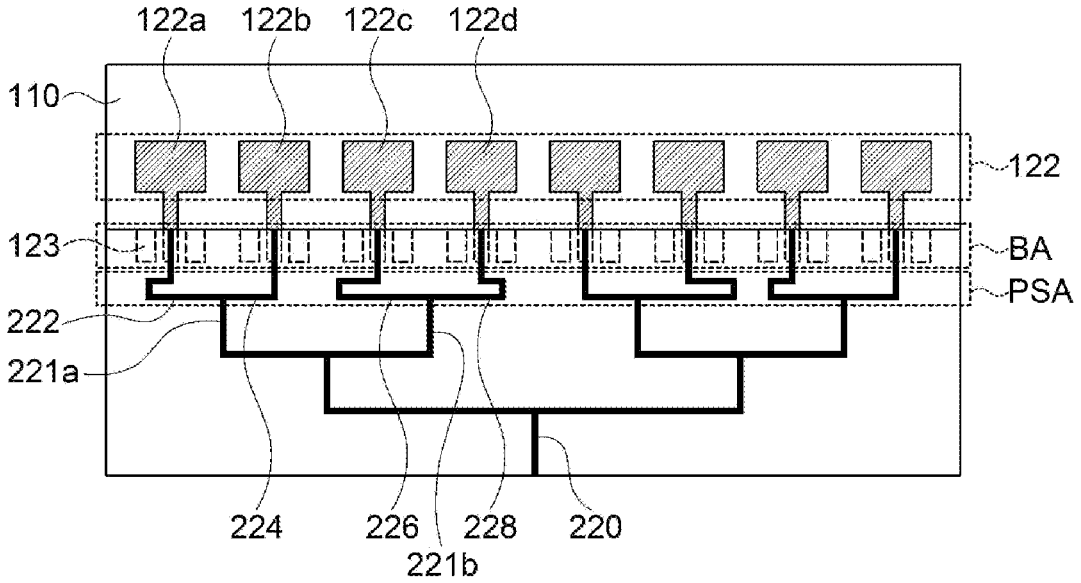
FIG. 3 is a schematic top planar view illustrating a connection of feeding wirings and radiation patterns in accordance with exemplary embodiments.

FIG. 3 is a schematic top planar view illustrating a connection of feeding wirings and radiation patterns in accordance with exemplary embodiments.

Referring to FIG. 3, a plurality of the radiation patterns 122 may be formed on the upper surface of the dielectric layer 110. For example, the radiation pattern 122 may include a first radiation pattern 122*a*, a second radiation pattern 122*b*, a third radiation pattern 122*c* and a fourth radiation pattern 122*d*. The feeding wiring 220 may include a plurality of individual wirings including a first individual wiring 222, a second individual wiring 224, a third individual wiring 226 and a fourth individual wiring 228.

For example, as illustrated in FIG. 3, the radiation patterns 122 may be arranged along the second direction. A distance between neighboring radiation patterns 122 may not be specifically limited, and may be properly adjusted to avoid a direct shot-circuit between the neighboring radiation patterns 122. The distances may be constant or different from each other. If the distances are uniform, a signal interference from the radiation patterns 122 may be reduced or averaged to improve a signaling efficiency.

In some embodiments, the neighboring radiation patterns 122 may have different phases. A beam angle may be tilted by a phase difference between the neighboring radiation patterns 122 so that beam coverage of the antenna device may be enlarged or expanded.

In exemplary embodiments, the feeding wiring 200 may include a plurality of the individual wirings each of which may be connected to each radiation pattern 122. The individual wiring may indicate each wiring extending from a connecting wiring 221*a* and 221*b* to be connected to each radiation pattern 122.

The neighboring individual wirings included at least one pair from the plurality of the individual wirings may have different lengths. For example, as illustrated in FIG. 3, the first individual wiring 222 and the third individual wiring 226 may each have a different length from that of the second individual wiring 224. In an embodiment, the first individual wiring 222, the second individual wiring 224, the third individual wiring 226 and the fourth individual wiring 228 may have different lengths from each other.

The phase difference between signals generated from the neighboring radiation patterns 122 may be created by the length difference of the individual wirings. In some embodiments, the phase difference may be defined by Equation 1 below.

$$\text{Phase difference } (\varphi)=\beta \sin \theta+\varphi_0 \qquad \text{[Equation 1]}$$

($\beta=2\pi/\lambda$, $\lambda$: resonance wavelength, $\theta$: beam direction, $\phi_0$: initial phase)

The beam direction may be an angle to which, e.g., an antenna pattern is directed, and may be defined by Equation 2 below.

$$\text{Beam direction } (\theta) = -\sin^{-1}\left(1 - \frac{m\lambda}{d}\right) \qquad \text{[Equation 2]}$$

(m: array number, $\lambda$: resonance wavelength, d: distance between centers of neighboring antennas)

For example, the distance between centers of neighboring antennas (d) may be $\lambda/2$.

Thus, the length difference between the neighboring individual wirings may be adjusted so that the phase difference from the radiation patterns 122 may be generated and a beam tilting angle of the antenna may be modified.

In some embodiments, the feeding wiring 220 may include connecting wirings 221*a* and 221*b* that may couple the individual wirings per a predetermined unit. For example, the first individual wiring 222 and the second individual wiring 224 may be coupled by the first connecting wiring 221*a*, and the third individual wiring 226 and the fourth individual wiring 228 may be coupled by the second connecting wiring 221*b*. The first connecting wiring 221*a* and the second connecting wiring 221*b* may be coupled to each other to form a connecting wiring unit, and the connecting wiring units may be coupled again to form the feeding wiring 220.

In exemplary embodiments, two neighboring individual wirings may be connected by the connecting wiring to define a plurality of feeding units. For example, a first feeding unit may be defined by the first individual wiring 222 and the second individual wiring 224 coupled by the first connecting wiring 221*a*. The first feeding unit may be connected to, e.g., the first radiation pattern 122*a* and the second radiation pattern 122*b*. In a similar manner, a second feeding unit may be defined by the third individual wiring 226 and the fourth individual wiring 228 coupled by the second connecting wiring 221*b*.

The individual wirings included in each feeding unit may have different lengths from each other. For example, the lengths of the first individual wiring 222 and the second individual wiring 224 in the first feeding unit may be different from each other, and the lengths of the third individual wiring 226 and the fourth individual wiring 228 in the second feeding unit may be different from each other. The phase difference between the radiation patterns 122 in each feeding unit may be created by the length difference of the individual wirings.

In some embodiments, the neighboring individual wirings included in different feeding units may have different lengths from each other. For example, the second individual wiring 224 of the first feeding unit and the third individual wiring 226 of the second feeding unit may have different lengths from each other. Thus, the phase difference between the radiation patterns 122 included in different feeding units may be also generated.

In exemplary embodiments, the phase difference generated from each feeding unit may be constant. For example, the phase difference between the first radiation pattern 122*a* and the second radiation pattern 122*b* from the first feeding unit may be equal to the phase difference between the third radiation pattern 122*c* and the fourth radiation pattern 122*d* from the second feeding unit. The terms "constant" and "equal" used herein may indicate "substantially constant" and "substantially equal," and may allow, e.g., ±10% error.

In exemplary embodiments, the phase difference between signals from the neighboring radiation patterns 122 may be constant. For example, the phase difference between signals from the first radiation pattern 122*a* and the second radiation pattern 122*b* may be equal to the phase difference between signals from the second radiation pattern 122*b* and the third radiation pattern 122*c*, and may be also equal to the phase difference between signals from the third radiation pattern 122*c* and the fourth radiation pattern 122*d*. The beam tilting may be more effectively implemented by constantly maintaining the phase difference.

In some embodiments, phases from the plurality of the radiation patterns 122 may uniformly increase or decrease in an arranging direction of the radiation patterns 122.

When the phases from the radiation patterns 122 may uniformly increase or decrease, the neighboring radiation patterns 122 may be coupled so that a beam forming angle may be tilted. For example, the plurality of the radiation patterns 122 may be entirely coupled so that the beam forming angle may be effectively tilted.

Figure 7:
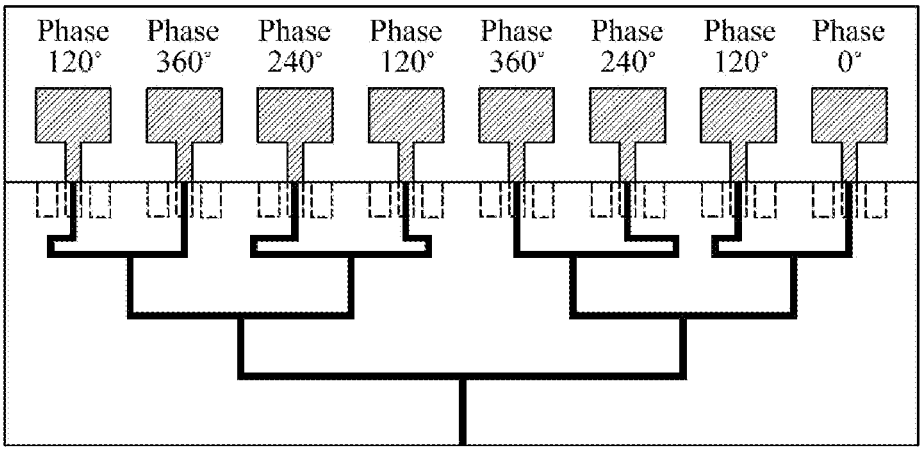
FIG. 7 is a schematic top planar view illustrating a phase difference between radiation patterns in accordance with exemplary embodiments.

FIG. 7 is a schematic top planar view illustrating a phase difference between radiation patterns in accordance with exemplary embodiments.

Referring to FIG. 7, in the antenna structure according to exemplary embodiments, phases of eight radiation patterns may increase by 120° from a rightmost radiation pattern (phase 0°) to a leftmost radiation pattern (phase 360° is equal to phase 0°). For example, the phase difference between the neighboring radiation patterns may be constantly set as 120°.

Figure 8:
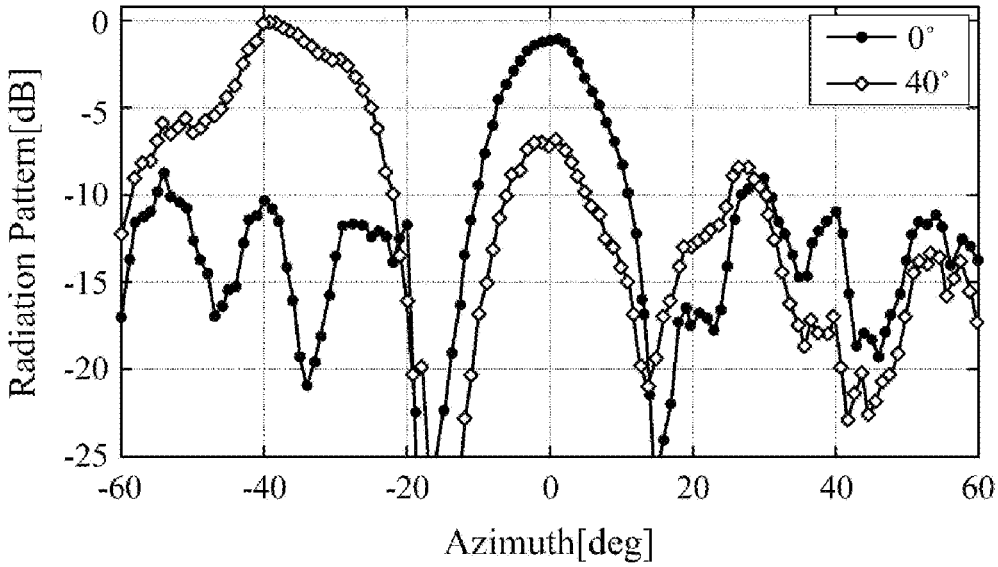
FIG. 8 is a graph showing a beam forming distribution in an antenna structure of FIG. 7.

FIG. 8 is a graph showing a beam forming distribution in an antenna structure of FIG. 7.

Referring to FIG. 8, in the antenna structure of FIG. 7, a main peak of beam forming showed at −40°. That is, a main beam forming angle was tilted by 40° from a comparative example including individual wirings with the same length and having a zero phase difference.

In some embodiments, the phase difference between signals from the neighboring radiation patterns may be in a range from 30° to 270°. Within this range, the beam coverage of the antenna structure may be more effectively expanded or enlarged. More preferably, the phase difference may be in a range from 60° to 180°.

In exemplary embodiments, end portions of the individual wirings may be electrically connected to the radiation patterns 122 in the bonding area BA. For example, a region at which portions of the individual wirings except for the end portions are located may be provided as a phase shift area PSA.

In some embodiments, at least one of the individual wirings included in each feeding unit may include a bent portion protruding in an arranging direction of the feeding units. For example, the bent portion may protrude in the second direction. The bent portion may be formed along the arranging direction of the feeding units so that the length difference between the individual wirings may be created without increasing a length of the antenna structure (e.g., a length in the first direction). Accordingly, a size of the antenna structure may be reduced.

In some embodiments, the length difference may be created between the individual wiring including the bent portion and the individual wiring without the bent portion. For example, the length difference between the first individual wiring 222 and the second individual wiring 224 may be caused by the length of the bent portion included in the first individual wiring 222. Further, the length difference may be also caused between a pair of the individual wirings including the bent portions. For example, a length of the bent portion in the third individual wiring 226 may be greater than a length of the bent portion in the fourth individual wiring 228, and thus the length difference between the neighboring individual wirings may be generated by the difference of the bent portions. Thus, a length difference of electrical paths may be induced to form the phase difference between signals from the radiation patterns 122.

In exemplary embodiments, at least one of the individual wirings may include the bent portion protruding in the arranging direction of the radiation patterns 122 in the phase shift area PSA.

For example, the bent portion may be formed in the phase shift area PSA to adjust the length of the individual wiring so that the phase difference may be easily adjusted without changing an arrangement of the radiation patterns 122 and a distance between the radiation patterns 122.

In some embodiments, a feeding ground pad may be disposed around the individual wiring. A pair of the feeding ground pads may be disposed with respect to the individual wiring to, e.g., face each other in the second direction. The feeding ground pad may be disposed at the same level in the third direction as that of the feeding wiring 220 and the individual wirings. The feeding ground pad may be in contact with the ground pad 123 and 125, and may be integral with the ground pad 123 and 125. The ground contact 235 may be formed through the feeding ground pad. A noise of an electrical signal through the individual wirings may be reduced by the feeding ground pad.

Figure 4:
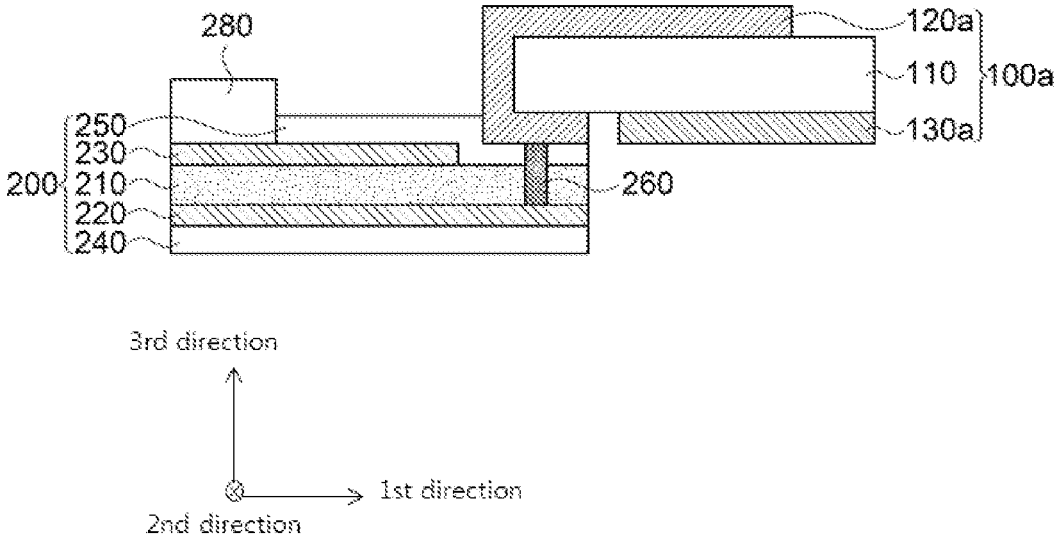
FIG. 4 is a schematic cross-sectional view illustrating an antenna structure in accordance with some exemplary embodiments.

FIG. 4 is a schematic cross-sectional view illustrating an antenna structure in accordance with some exemplary embodiments.

Referring to FIG. 4, the flexible circuit board 200 may be disposed under an antenna device 100*a*. For example, the flexible circuit board 200 may be combined with the antenna device 100*a* toward the lower surface of the dielectric layer 110.

In this case, as illustrated in FIG. 4, the feeding wiring 220 may be electrically connected to an antenna electrode layer 120*a* via a feeding contact 260. In some embodiments, the antenna electrode layer 120*a* may be bent along a sidewall of the dielectric layer 110 to extend on the lower surface of the dielectric layer 110. For example, a signal pad of the antenna electrode layer 120*a* may be disposed on the lower surface of the dielectric layer 110 so that a connection with the feeding wiring 220 may be easily implemented via the feeding contact 260.

The ground pad of the antenna electrode layer 120*a* may be also bent along the sidewall of the dielectric layer 110 to be disposed on the lower surface of the dielectric layer 110, and may be electrically connected to the feeding ground layer 230 of the flexible circuit board 200. In an embodiment, a portion of the ground pad on the surface of the dielectric layer 110 may be integrally connected to an antenna ground layer 130*a*.

Figure 5:
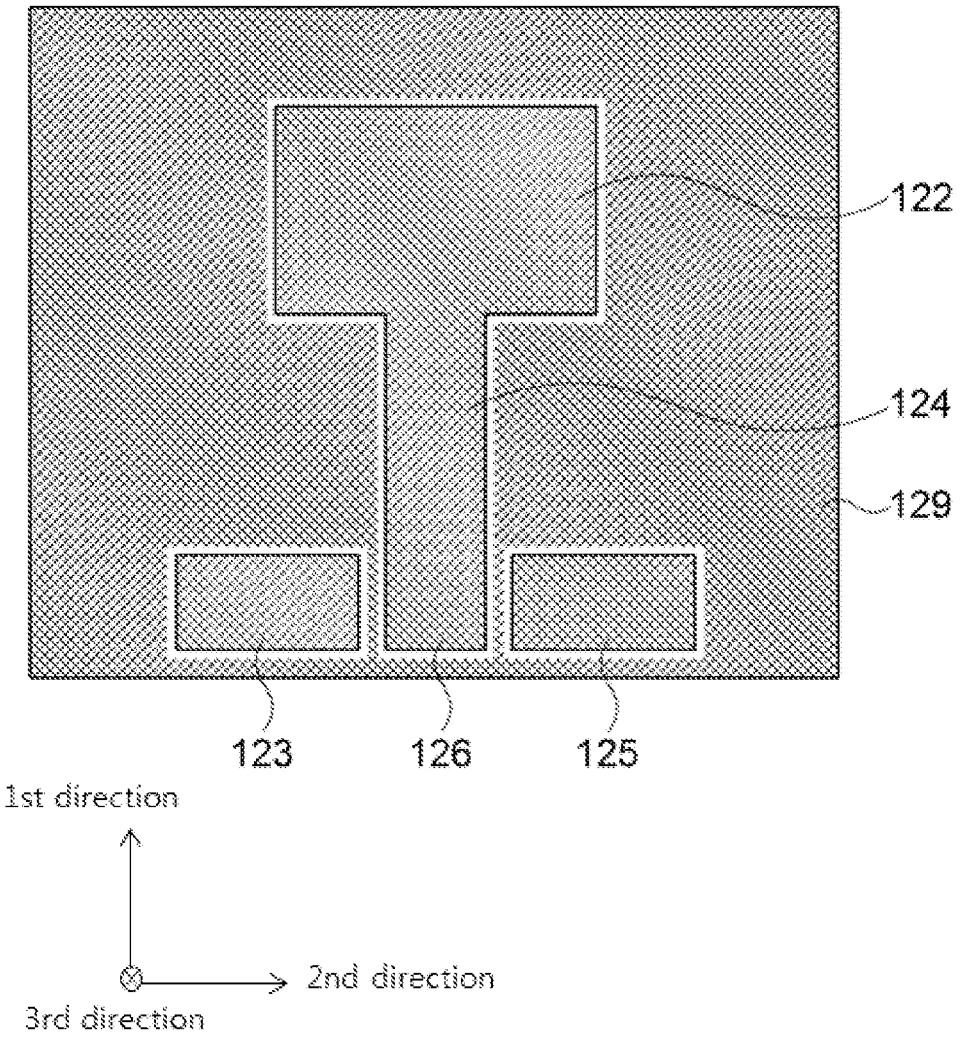
FIG. 5 is a schematic top planar view illustrating a construction of an antenna electrode layer included in an antenna structure in accordance with some exemplary embodiments.

FIG. 5 is a schematic top planar view illustrating a construction of an antenna electrode layer included in an antenna structure in accordance with some exemplary embodiments.

Referring to FIG. 5, the antenna electrode layer 120 may include a mesh structure. As illustrated in FIG. 5, the radiation pattern 122, the transmission line 124, the signal pad 126 and the ground pad 123 and 125 may include the mesh structure.

In some embodiments, the signal pad 126 and the ground pad 123 and 125 may be formed as a solid pattern so that a signal loss due to a resistance increase may be prevented.

The antenna electrode layer 120 may include the mesh structure so that a transmittance of the antenna device 100 may be improved. In some embodiments, a dummy mesh layer 129 may be formed around the antenna electrode layer 120. An electrode shape or construction around the antenna electrode layer 120 (e.g., around the radiation pattern 122) may be averaged by the dummy mesh layer 129 so that the antenna electrode layer 120 may be prevented from being viewed by a user of a display device.

For example, a mesh metal layer may be formed on the dielectric layer 110, and then may be etched along a predetermined region so that the dummy mesh layer 129 electrically and physically separated from the radiation pattern 122 and the transmission line 124 may be formed.

Figure 6:
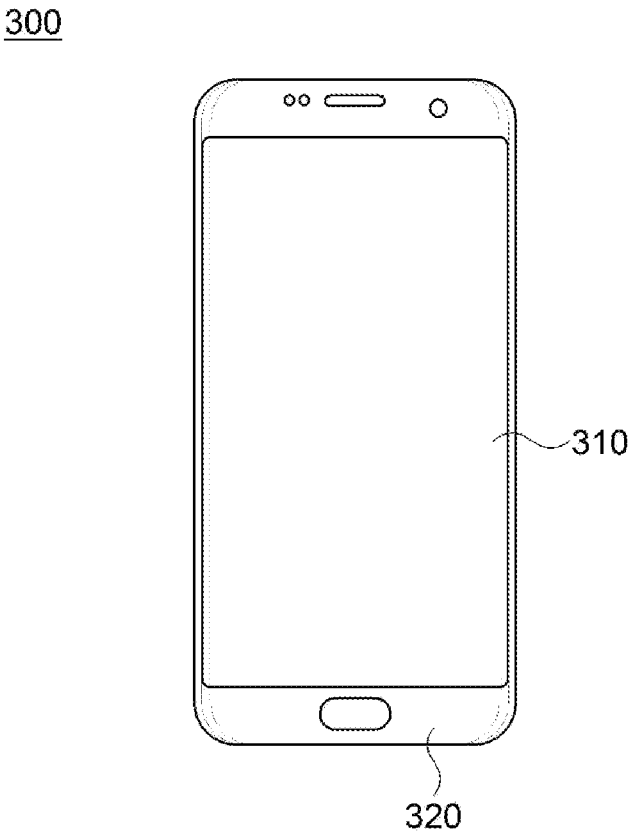
FIG. 6 is a schematic top planar view illustrating a display device in accordance with exemplary embodiments.

FIG. 6 is a schematic top planar view illustrating a display device in accordance with exemplary embodiments. For example, FIG. 6 illustrates an outer shape including a window of a display device.

Referring to FIG. 6, a display device 300 may include a display region 310 and a peripheral region 320. The peripheral region 320 may correspond to both end portions and/or both lateral portions around the display region 310.

In some embodiments, the antenna device 100 included in the antenna structure may be inserted in the peripheral region 320 of the display device 300 as a patch. In some embodiments, the pad electrodes 123, 125 and 126 may be disposed in the peripheral region 320 of the display device 300.

The peripheral region 320 may correspond to a light-shielding portion or a bezel portion of the display device. In exemplary embodiments, the flexible circuit board 200 of the antenna structure may be disposed in the peripheral region 320 so that a degradation of an image quality from the display region 310 may be prevented.

The driving IC chip 280 may be also disposed in the peripheral region 320. The pad electrodes 123, 125 and 126 of the antenna device 100 may be disposed to be adjacent to the flexible circuit board 200 and the driving IC chip 280 in the peripheral region 320 so that a length of a signal transfer path may be decreased to prevent a signal loss.

The radiation patterns 122 of the antenna device 100 may at least partially overlap the display region 310. For example, as illustrated in FIG. 5, the radiation pattern 122 may include the mesh structure to reduce visibility of the radiation pattern 122.

What is claimed is:

1. An antenna structure, comprising:

an antenna device comprising a dielectric layer and a plurality of radiation patterns on an upper surface of the dielectric layer; and a flexible circuit board comprising a feeding wiring electrically connected to the radiation patterns, the feeding wiring comprising a plurality of individual wirings, each of which electrically connected to each of the radiation patterns, wherein lengths of neighboring individual wirings included in at least one pair from the plurality of individual wirings are different from each other, wherein the antenna electrode layer further comprises a signal pad electrically connected to each of the radiation patterns, and the feeding wiring is electrically connected to the signal pad, wherein the flexible circuit board comprises a core layer and a feeding ground layer formed on an upper surface of the core layer, and the feeding wiring is disposed on a lower surface of the core layer.

2. The antenna structure according to claim 1, wherein the feeding wiring further comprises a connecting wiring that couples the neighboring individual wirings in a predetermined unit.

3. The antenna structure according to claim 2, wherein the neighboring individual wirings are connected to each other by the connecting wiring to define a plurality of feeding units, and lengths of the individual wirings included in each of the feeding units are different from each other.

4. The antenna structure according to claim 3, wherein lengths of individual wirings neighboring each other which are included in different feeding units of the plurality of the feeding units are different from each other.

5. The antenna structure according to claim 3, wherein a phase difference is generated between the radiation patterns connected to each of the feeding units, and the phase difference from each of the feeding units is constant.

6. The antenna structure according to claim 5, wherein a phase difference is generated by neighboring individual wirings included in different feeding units of the plurality of feeding units, and the phase difference by the neighboring individual wirings included in the different feeding units is equal to the phase difference from each of the feeding units, wherein phases of the plurality of the radiation patterns constantly increase or decrease in an arrangement direction thereof.

7. The antenna structure according to claim 3, wherein at least one of the individual wirings included in each of the feeding units has a bent portion protruding in an arrangement direction of the feeding units.

8. The antenna structure according to claim 1, wherein the antenna electrode layer further comprises a ground pad around the signal pad, and the feeding ground layer of the flexible circuit board is electrically connected to the ground pad.

9. The antenna structure according to claim 8, further comprising a ground contact electrically connecting the feeding ground layer and the ground pad to each other.

10. The antenna structure according to claim 1, wherein the flexible circuit board is disposed on the antenna electrode layer of the antenna device.

11. The antenna structure according to claim 1, wherein the flexible circuit board is disposed under a lower surface of the dielectric layer of the antenna device.

12. The antenna structure according to claim 11, wherein the antenna electrode layer is bent along a sidewall of the dielectric layer and extends on the lower surface of the dielectric layer.

13. The antenna structure according to claim 12, wherein the flexible circuit board further comprises a feeding contact electrically connecting the antenna electrode layer and the feeding wiring to each other.

14. The antenna structure according to claim 1, wherein the antenna device further comprises an antenna ground layer disposed on the lower surface of the dielectric layer.

15. The antenna structure according to claim 1, further comprising a driving integrated circuit chip being disposed on the flexible circuit board and supplying a power with the antenna electrode layer via the feeding wiring.

16. The antenna structure according to claim 1, wherein the antenna electrode layer comprises a mesh structure.

17. The antenna structure according to claim 16, wherein the antenna device further comprises a dummy mesh layer around the antenna electrode layer.

18. A display device comprising the antenna structure according to any one of claim 1.

* * * * *